US009180706B2

(12) United States Patent
Hoffman et al.

(10) Patent No.: US 9,180,706 B2
(45) Date of Patent: Nov. 10, 2015

(54) CANTILEVERED CREDENTIAL PROCESSING DEVICE COMPONENT

(75) Inventors: Ted M. Hoffman, Eden Prairie, MN (US); Thomas G. Gale, Jr., Robbinsdale, MN (US)

(73) Assignee: Assa Abloy AB, Stockholm (SE)

( * ) Notice: Subject to any disclaimer, the term of this patent is extended or adjusted under 35 U.S.C. 154(b) by 1044 days.

(21) Appl. No.: 11/683,835

(22) Filed: Mar. 8, 2007

(65) Prior Publication Data

US 2008/0216686 A1 Sep. 11, 2008

(51) Int. Cl.
*B41J 25/316* (2006.01)
*B41J 29/02* (2006.01)

(52) U.S. Cl.
CPC ..... *B41J 29/02* (2013.01); *B41J 25/316* (2013.01)

(58) Field of Classification Search
USPC ..... 400/691
See application file for complete search history.

(56) References Cited

U.S. PATENT DOCUMENTS

| | | | | |
|---|---|---|---|---|
| 2,401,719 | A | | 6/1946 | Braun |
| 3,513,957 | A | | 9/1967 | Ricciardi et al. |
| 3,731,781 | A | | 5/1973 | Caudill et al. |
| 3,933,350 | A | | 1/1976 | Mignano |
| 3,948,506 | A | | 4/1976 | Crimmins et al. |
| 3,961,785 | A | | 6/1976 | Gall |
| 3,975,010 | A | | 8/1976 | Schisselbauer et al. |
| 4,299,504 | A | | 11/1981 | Benz et al. |
| 4,305,577 | A | | 12/1981 | Clay et al. |
| 4,458,890 | A | | 7/1984 | Kawazu |
| 4,527,149 | A | * | 7/1985 | Swensen ..... 400/691 |
| 4,568,074 | A | | 2/1986 | Murayoshi |
| 4,590,486 | A | | 5/1986 | Yana |
| 4,592,634 | A | | 6/1986 | Koch |
| 4,607,832 | A | | 8/1986 | Abe |
| 4,609,298 | A | | 9/1986 | Shioda |
| 4,615,628 | A | | 10/1986 | Swinburne |
| 4,685,815 | A | * | 8/1987 | Baranyi ..... 400/120.16 |
| 4,772,146 | A | * | 9/1988 | Saito et al. ..... 400/649 |
| 4,869,455 | A | | 9/1989 | Weeks |
| 4,938,616 | A | * | 7/1990 | Shiozaki et al. ..... 400/120.16 |
| 4,990,008 | A | | 2/1991 | Hwang |
| 5,004,218 | A | | 4/1991 | Sardano et al. |
| 5,037,216 | A | * | 8/1991 | Nubson et al. ..... 400/208 |
| 5,050,852 | A | | 9/1991 | Sawada et al. |

(Continued)

FOREIGN PATENT DOCUMENTS

| | | |
|---|---|---|
| GB | 2343658 | 5/2000 |
| JP | 07040615 A | 2/1995 |

(Continued)

OTHER PUBLICATIONS

Search Report and Written Opinion dated May 30, 2008 for International Application No. PCT/US2008/000853.

(Continued)

*Primary Examiner* — Jill Culler
(74) *Attorney, Agent, or Firm* — Westman, Champlin & Koehler, P.A.

(57) ABSTRACT

A credential production device is disclosed. The credential production device includes a frame, a support member and a credential processing device component. The support member is coupled to the frame and includes a first portion cantilevered from the frame. The credential processing device component is coupled to the first portion of the support member.

20 Claims, 6 Drawing Sheets

(56) References Cited

U.S. PATENT DOCUMENTS

| | | | | |
|---|---|---|---|---|
| 5,064,301 | A | 11/1991 | Nakamura et al. | |
| 5,102,116 | A | 4/1992 | Garavuso | |
| 5,165,806 | A * | 11/1992 | Collins | 400/248 |
| 5,220,355 | A * | 6/1993 | Miyawaki | 347/199 |
| 5,229,586 | A | 7/1993 | Ishii | |
| 5,301,834 | A | 4/1994 | Lee et al. | |
| 5,366,306 | A | 11/1994 | Mizutani et al. | |
| 5,443,319 | A | 8/1995 | Sugiura et al. | |
| 5,453,852 | A | 9/1995 | Morikawa et al. | |
| 5,519,429 | A | 5/1996 | Zwijsen et al. | |
| 5,546,115 | A | 8/1996 | Nardone et al. | |
| 5,547,298 | A | 8/1996 | Wouters et al. | |
| 5,558,449 | A | 9/1996 | Morgavi | |
| 5,597,248 | A | 1/1997 | Burgin | |
| 5,739,835 | A | 4/1998 | Morgavi et al. | |
| 5,769,548 | A | 6/1998 | Thompson et al. | |
| 5,829,631 | A | 11/1998 | Kasper | |
| 5,895,157 | A * | 4/1999 | Morimura et al. | 400/208 |
| 5,936,646 | A | 8/1999 | Kenny et al. | |
| 5,941,522 | A | 8/1999 | Hagstrom et al. | |
| 6,151,478 | A | 11/2000 | Katsuta et al. | |
| 6,190,069 | B1 | 2/2001 | Yamaguchi et al. | |
| 6,261,012 | B1 * | 7/2001 | Haas et al. | 400/208 |
| 6,390,697 | B1 * | 5/2002 | O'Mera et al. | 400/120.16 |
| 6,422,554 | B1 | 7/2002 | Wuethrich et al. | |
| 6,486,904 | B1 | 11/2002 | Onozato et al. | |
| 6,550,761 | B1 | 4/2003 | Chiang | |
| 6,604,876 | B2 | 8/2003 | Bryant et al. | 400/208 |
| 6,616,360 | B2 | 9/2003 | Lehmkuhl | |
| 6,626,298 | B2 | 9/2003 | Lax | |
| 6,626,594 | B1 | 9/2003 | Lallemant | |
| 6,682,241 | B2 | 1/2004 | Coons et al. | |
| 6,714,228 | B1 | 3/2004 | Holland et al. | |
| 6,827,509 | B2 | 12/2004 | Suden et al. | |
| 6,910,656 | B2 | 6/2005 | Lysiak et al. | |
| 7,018,117 | B2 | 3/2006 | Meier et al. | |
| 7,549,633 | B2 | 6/2009 | Nishitani et al. | |
| 2001/0046401 | A1 | 11/2001 | Lien et al. | |
| 2003/0025781 | A1 * | 2/2003 | Honma et al. | 347/213 |
| 2004/0109715 | A1 | 6/2004 | Meier et al. | |
| 2004/0114981 | A1 | 6/2004 | Meier et al. | |
| 2005/0078998 | A1 | 4/2005 | Lien et al. | |
| 2005/0095049 | A1 | 5/2005 | Yoshida et al. | |
| 2005/0242487 | A1 | 11/2005 | Pelletier et al. | |

FOREIGN PATENT DOCUMENTS

| | | | |
|---|---|---|---|
| JP | 07256755 | A | 10/1995 |
| JP | 10016186 | A | 1/1998 |
| WO | 2004022464 | A1 | 3/2004 |
| WO | WO 2005/096724 | | 3/2005 |

OTHER PUBLICATIONS

Search Report and Written Opinion dated Jun. 26, 2008 for International Application No. PCT/US2008/001031.

Search Report and Written Opinion dated Jun. 26, 2008 for International Application No. PCT/US2008/002207.

Search Report and Written Opinion dated Jun. 4, 2008 for International Application No. PCT/US2008/000851.

A First Office Action for Chinese Patent Application No. 200880007497.2, dated Jun. 15, 2011.

A Second Office Action from Chinese Patent Application No. 200880007497.2, mailed Mar. 15, 2012.

Supplemental European Search Report from European application No. 08 72 4845, dated Nov. 15, 2013.

* cited by examiner

CANTILEVERED CREDENTIAL PROCESSING DEVICE COMPONENT

CROSS-REFERENCE TO RELATED APPLICATIONS

This application incorporates herein by reference in their entirety the following applications filed on Mar. 8, 2007: U.S. patent application Ser. No. 11/683,771 entitled "SUBSTRATE FEEDING IN A CREDENTIAL PRODUCTION DEVICE" having inventors Ted M. Hoffman, Jeffrey L. Stangler, John P. Skoglund and Tony Nauth; U.S. patent application Ser. No. 11/683,795 entitled "CARD HOLDER FOR A CREDENTIAL PRODUCTION DEVICE" having inventors Ted M. Hoffman, Jeffrey L. Stangler and John P. Skoglund; U.S. patent application Ser. No. 11/683,816 entitled "CREDENTIAL PRODUCTION PRINT RIBBON AND TRANSFER RIBBON CARTRIDGES" having inventor Ted M. Hoffman; U.S. patent application Ser. No. 11/683,827 entitled "PRINTHEAD ASSEMBLY FOR A CREDENTIAL PRODUCTION DEVICE" having inventor Ted M. Hoffman; U.S. patent application Ser. No. 11/683,710 entitled "CREDENTIAL PRODUCTION DEVICE HAVING A UNITARY FRAME" having inventors Ted M. Hoffman and James R. Cedar; and U.S. patent application Ser. No. 11/683,850 entitled "INVERTED REVERSE-IMAGE TRANSFER PRINTING" having inventors Ted M. Hoffman, Jeffrey L. Stangler, John P. Skoglund, Thomas G. Gale Jr. and Tony Nauth.

FIELD OF THE INVENTION

The present invention is generally directed to a credential production device. More particularly, the present invention is directed to a credential processing device component used in processing a credential substrate in a credential production device.

BACKGROUND OF THE INVENTION

Credential products include, for example, identification cards, driver's licenses, passports, and other valuable documents. Such credentials are formed from credential substrates including paper substrates, plastic substrates, cards and other materials. Such credentials generally include printed information, such as a photo, account numbers, identification numbers, and other personal information that is printed on the credential substrates using a print consumable, such as ink and ribbon.

Credential processing devices process credential substrates by performing at least one step in forming a final credential product. One type of credential production device is a reverse-image credential production device. Reverse-image credential production devices generally include a printing section and an image transfer section. The printing section utilizes an intermediate transfer film or transfer ribbon, a print ribbon and a printhead. The printhead is typically a thermal printhead that operates to heat different colored dye panels of a thermal print ribbon to transfer the colored dye from the print ribbon to a panel of transfer film to form the image thereon. After the printed image on the transfer film is registered with a substrate, a heated transfer roller of the image transfer section transfers the image from the transfer film or transfer ribbon to a surface of the substrate.

Conventional reverse-image credential production devices are typically large, cumbersome and complicated machines where improvements to these types of machines are in continuous demand. For example, there is a continuous demand for improving the functionality of credential processing device components, such as printheads, transfer rollers, platens and other types of components used in processing the credential product in the credential production device, while reducing the amount of space needed for such devices.

Embodiments of the present invention provide solutions to these and other problems, and offer other advantages over the prior art.

SUMMARY OF THE INVENTION

Embodiments of the invention are directed to a credential production device. One embodiment of the credential production device includes a frame, a support member and a credential processing device component. The support member is coupled to the frame and includes a first portion cantilevered from the frame. The credential processing device component is coupled to the first portion of the support member.

In accordance with another embodiment, the credential production device includes a frame, a support member, a transfer roller and an actuation mechanism. The support member is coupled to the frame and includes a first portion cantilevered form the frame. The transfer roller is coupled to the first portion of the support member. The actuation mechanism is configured to move the transfer roller into a transfer ribbon path to apply a transfer ribbon to a credential substrate.

Another embodiment of the invention is directed to a credential processing assembly for a credential production device. The credential processing assembly includes a support member, a credential processing device component and an actuation mechanism. The support member is coupled to a fixed frame and includes a first portion pivotally cantilevered from the frame. The credential processing device component is rotatably coupled to the first portion of the support member. The actuation mechanism is configured to move the credential processing component device into an operating position for processing a credential substrate.

DETAILED DESCRIPTION OF THE PREFERRED EMBODIMENTS

Figure 1:
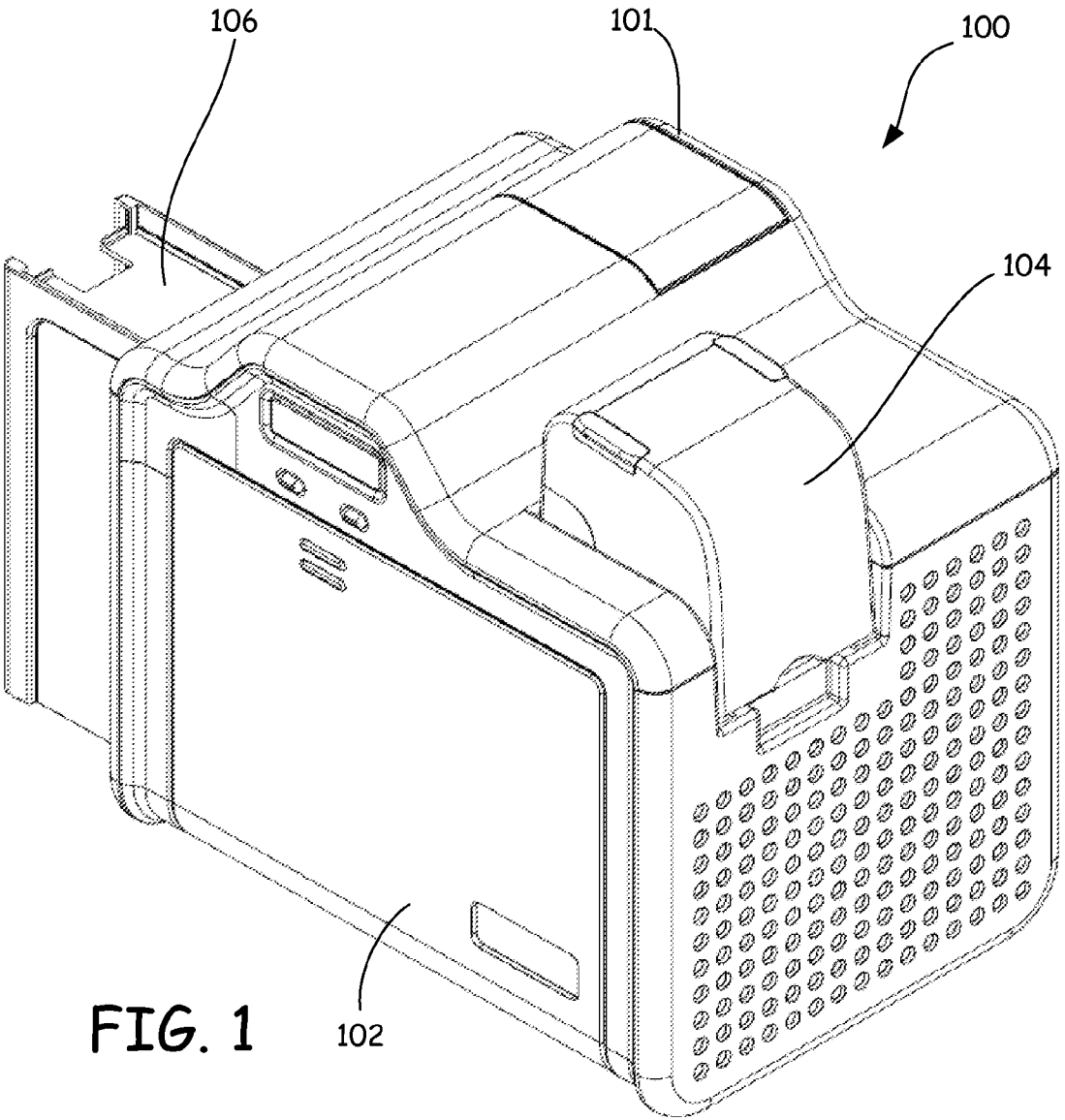
FIG. 1 is a perspective view of a credential production device under embodiments of the invention.
Figure 2:
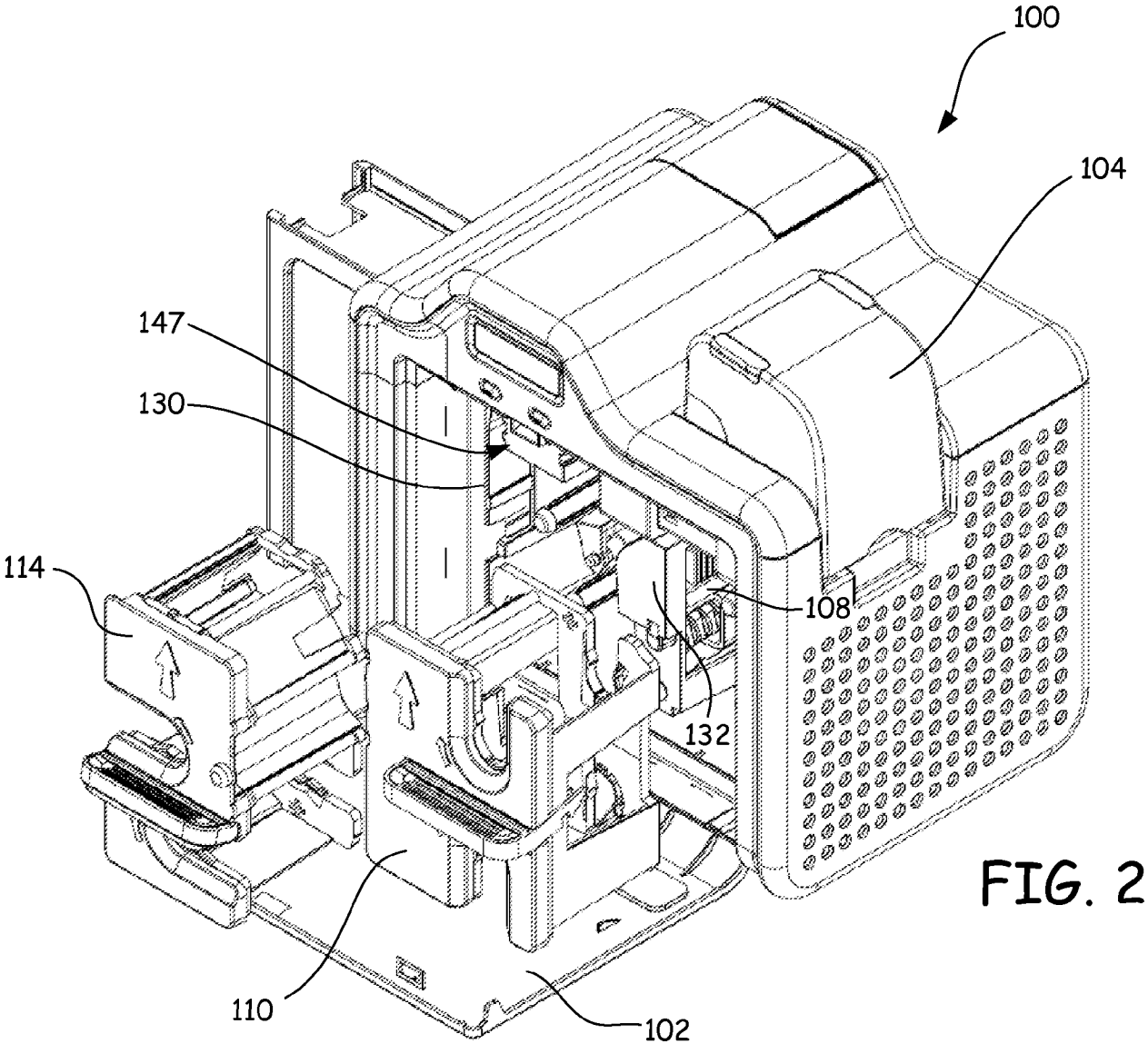
FIG. 2 is an exploded perspective view of the credential production device of FIG. 1.
Figure 3:
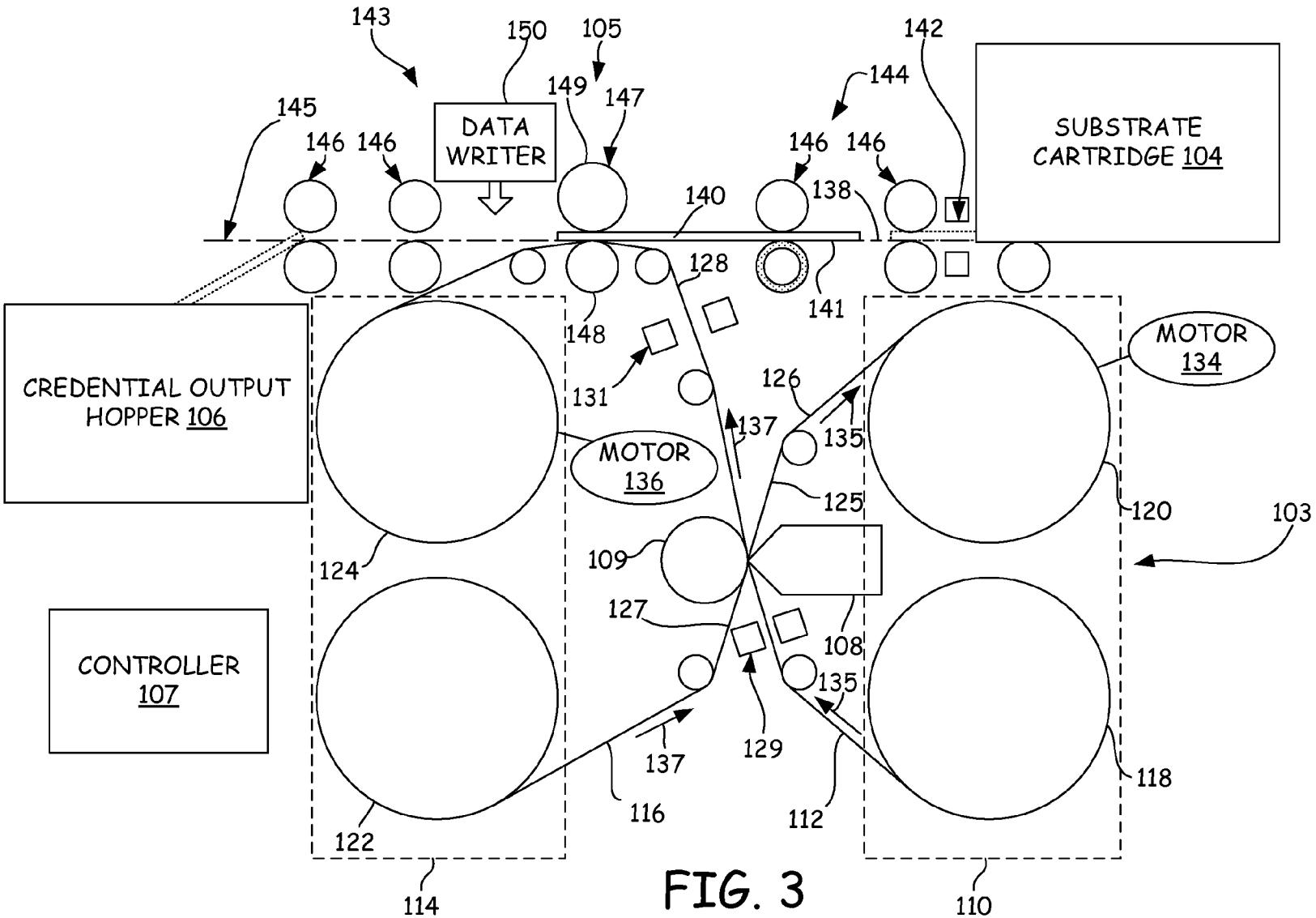
FIG. 3 is a simplified schematic diagram of the credential production device illustrated in FIGS. 1 and 2.

FIGS. 1 and 2 illustrate perspective views of a credential production device 100 in accordance with embodiments of the invention. FIG. 3 illustrates a simplified schematic diagram of device 100 in accordance with embodiments of the invention.

FIG. 1 illustrates an exterior view of credential production device 100 and FIG. 2 illustrates an exploded view of credential production device 100. Embodiments of the disclosure pertain to credential production device 100 as being a reverse-image printer and, therefore, embodiments of the disclosure pertain to the use of a transfer film roller used for transferring ink from a transfer film to a credential substrate in a reverse-image printer. However, it should be understood that embodiments of the transfer roller in the disclosure can also be used in other types of credential production devices such as non-reverse-image credential printing devices and credential laminating devices. In addition, it should be understood that features of the embodiments of the transfer roller can be used in other types of credential production device components such as support rollers and platens, printheads and etc. Before discussing embodiments of the transfer roller in detail, components of credential production device 100 will be briefly described.

Credential production device 100 provides inverted reverse-image transfer printing using a transfer roller that is inverted relative to a position of transfer rollers in a conventional reverse-image printing device with respect to a processing path. Unlike conventional production devices, the inverted nature of device 100 locates the transfer roller and other types of production components below its processing path. Such a configuration allows credential production device 100 to be formed more compactly, especially in height, allows heat from the transfer roller to more efficiently dissipate and simplifies a processing path of which a credential substrate is transported.

In the embodiment illustrated in FIG. 1, credential production device 100 includes an enclosure 101 having a front panel 102. Credential production device 100 utilizes a substrate cartridge 104, a substrate transport mechanism to transport credential substrates along a processing path 138 and a credential output hopper 106. In addition to the location of production components in credential production device 100 being below processing path 138, configurations of many production components within credential production device 100 allow the device to be more compact than conventional credential production devices.

In FIG. 2, front panel 102 is removed to more clearly describe main production components internal to credential production device 100. Credential production device 100 includes a printing section 103 and an image transfer section 105. A controller 107 generally controls the components of credential production device 100 to perform various operations including printing, image transfer, sensor calibration and other operations.

In one embodiment, printing section 103 includes a printhead 108, a print platen 109, a print ribbon cartridge 110 for supporting a print ribbon 112 and a transfer ribbon cartridge 114 for supporting a transfer ribbon 116. As illustrated in FIG. 2, cartridges 110 and 114 are releasable and removable from credential production device 100 for loading and unloading print ribbon 112 and transfer ribbon 116. Print ribbon 112 (e.g., dye sublimation print ribbon) is wound about a supply spool 118 and a take-up spool 120. Transfer ribbon 116 is wound about a supply spool 122 and a take-up spool 124. Print ribbon 112 includes a first side 125 and a second side 126 opposite the first side. When print ribbon 112 is wound about spools 118 and 120, first side 125 faces the interior of print ribbon cartridge 110 and second side 126 faces transfer ribbon cartridge 114. Transfer ribbon 116 includes a first side 127 and a second side 128 opposite the first side. When transfer ribbon 116 is wound about spools 122 and 124, first side 127 faces the interior of transfer ribbon cartridge 114 and second side 128 faces print ribbon cartridge 110.

In one embodiment, credential production device 100 includes an internal frame 130 that is configured to house print ribbon cartridge 110 and transfer ribbon cartridge 114 after print ribbon 112 is loaded onto print ribbon cartridge 110, after transfer ribbon 116 is loaded onto transfer ribbon cartridge 114 and both cartridges are inserted into credential production device 100. When print ribbon cartridge 110 is inserted into internal frame 130 of credential production device 100, embodiments of print ribbon cartridge 110 also receive a printhead housing 132 contained in internal frame 130. Printhead housing 132 houses printhead 108, which is a credential processing device component. Print ribbon cartridge 110 allows printhead 108 to rotate about a rotation path such that burn elements on printhead 108 face and apply pressure on print platen 109 and therefore places second side 126 of print ribbon 112 in contact with second side 128 of transfer ribbon 116.

In one embodiment, credential production device 100 includes a print ribbon sensor 129 and a transfer ribbon sensor 131. Print ribbon sensor 129 is configured to detect different color frames or panels of print ribbon 112. The frames or panels repeat in a sequence or group consisting of a yellow, magenta and cyan frames or panels. In addition, print ribbon 112 can include a black resin frame or panel in the sequence of color frames or panels, if desired. Print ribbon sensor 129 detects the colored frames or panels for controller 107, which uses signals derived from the sensed frames or panels to control motor 134. Motor 134 feeds print ribbon 112 in a direction indicated by arrows 135. Transfer ribbon sensor 131 is configured to sense opaque transition marks (not illustrated) that separate substantially clear or transparent panels along the length of transfer ribbon 116. Transfer film sensor 131 detects the transition marks for the controller 107, which uses signals derived from the sensed transition marks to control motor 136. Motor 136 feeds transfer ribbon 116 in a direction indicated by arrows 137.

While motors 134 and 136 are operating, printhead 108 applies pressure against print platen 109 such that printhead 108 is in contact with first side 125 of print ribbon 112 and brings print ribbon 112 in contact with second side 128 of transfer ribbon 116. In one embodiment, printhead 108 is a thermal printhead having a plurality of burn elements that transfer a reverse image onto a panel of transfer ribbon 116 using print ribbon 112. Printhead 108 prints each panel of transfer ribbon 116 while oriented approximately perpendicularly to processing path 138. The reverse image on the panel of transfer ribbon 116 is then moved towards credential substrate path 138 for transferring the reverse image to a credential substrate 140.

In another embodiment, image transfer section 105 includes a substrate input 142, a substrate transport 143, a transfer mechanism 144 and a substrate output 145. Credential substrates 140 are received by substrate transport 143 from substrate cartridge 104 at substrate input 142. Controller 107 controls substrate transport 143 to feed individual credential substrates 140 along processing path 138. In one embodiment, processing path 138 is substantially flat between substrate input 142 and substrate output 145 to avoid any bending or damaging of substrates 140, particularly when they are in the form of rigid or semi-rigid plastic substrates used to form identification cards. Substrate transport 143 includes substrate feed rollers 146 that are driven by a motors through gear and pulley arrangements. It should be noted that in some embodiments separate motors can be used for different stages of substrate transport through credential production device 100. For example, a motor can be used to drive the feeding of a substrate 140 through substrate input 142 and another motor can be used to drive the feeding of substrate 140 through the remaining substrate path 138 in credential production device 100.

When transfer ribbon cartridge 114 is inserted into credential production device 100, as previously discussed, embodiments of transfer ribbon cartridge 114 also receive a portion of a transfer roller assembly 147 (FIG. 2) that includes a transfer roller 148, which is a credential production device component illustrated in FIG. 3. Transfer roller 148 is a roller capable of being heated and capable being cooled. Transfer ribbon cartridge 114 allows transfer roller assembly 147 to move and therefore allows transfer roller 148 to apply pressure on a platen 149. During image transfer, transfer roller 148 is in contact with first side 127 of transfer ribbon 116 and presses transfer ribbon 116 and substrate 140 against platen 149 such that the reverse image printed on transfer ribbon 116 is transferred onto a bottom side 141 of substrate 140. Transfer roller 148 uses heat and pressure to transfer the reverse image printed on transfer ribbon 116 onto substrate 140.

In one embodiment, the credential production device 100 includes a data reader/writer 150 configured to read and/or write data to the substrate 140. Exemplary data reader/writers 150 include magnetic stripe reader/writers configured to read data from and/or write data to a magnetic stripe on the credential substrate 140, a bar code reader/writers configured to read data from a barcode on the substrate 140 and/or write data to the barcode on the substrate 140, a memory reader/writer, such as a smartcard encoder, configured to read data from a memory of the substrate 140 and/or write data to the memory of the substrate 140, and other data reader/writers. In one embodiment, the data reader/writer 150 is positioned above the processing path 138 and is configured to read and/or write data at a top surface of the substrate 140.

Figure 4:
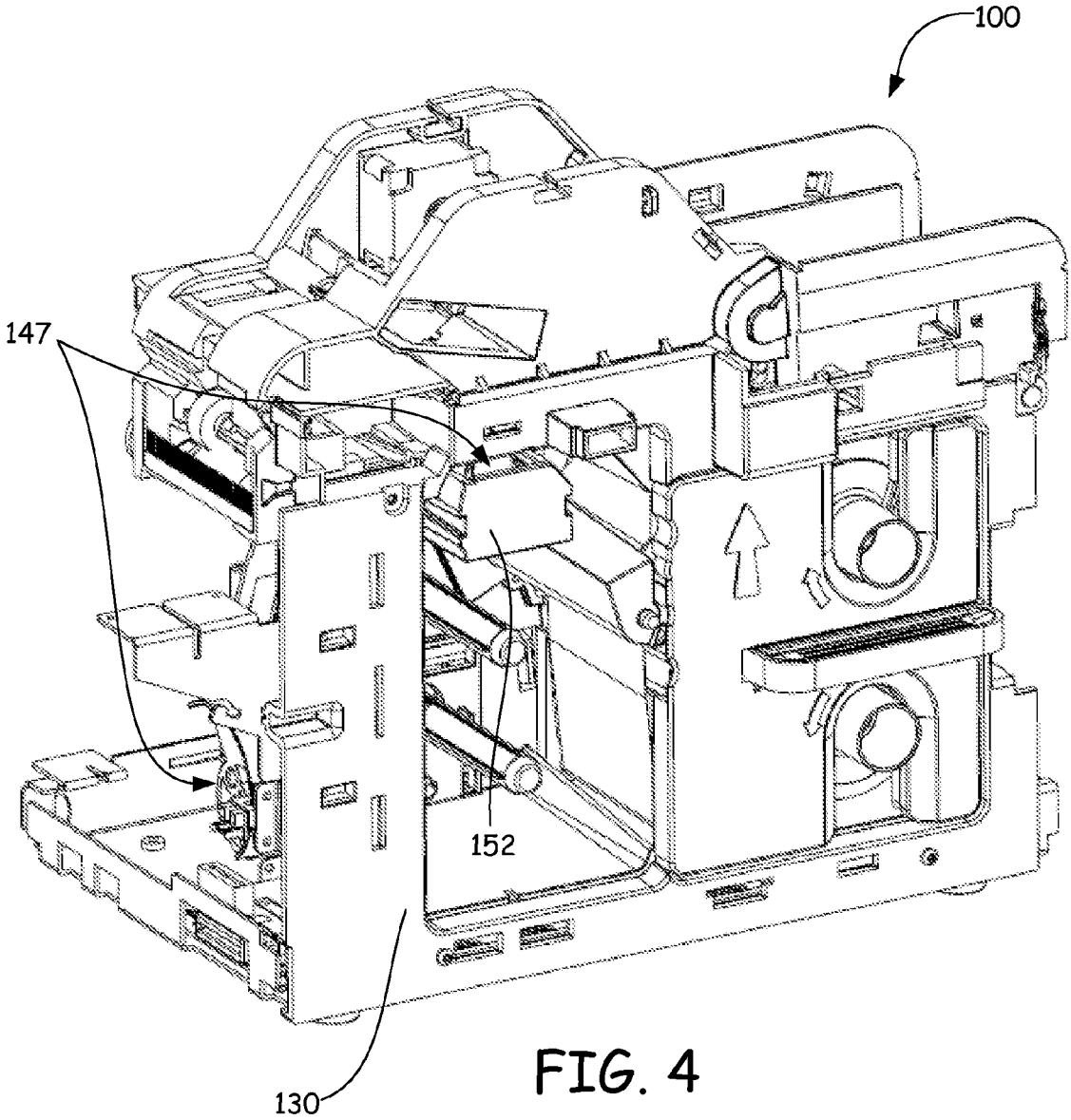
FIG. 4 illustrates a front perspective view of the credential production device of FIGS. 1-3 including a loaded print ribbon cartridge with the enclosure removed.

FIG. 4 illustrates a front perspective view of credential production device 100 including a loaded print ribbon cartridge 110 with enclosure 101 illustrated in FIG. 1 removed. In FIG. 4, transfer ribbon cartridge 114 is removed to clearly illustrate a transfer roller assembly housing 152 that is positioned towards an upper portion of internal frame 130 and within where transfer ribbon cartridge 114 is to be loaded. Transfer roller assembly housing 152 is configured to house the portion of transfer roller assembly 147 (partially hidden from view in FIG. 4). When transfer ribbon cartridge 114 (FIG. 2) is inserted into internal frame 130, transfer roller assembly housing 152 is positioned within transfer ribbon cartridge 114. Such a position is schematically represented in the FIG. 5 illustration of a rear plan view of transfer ribbon cartridge 114 having supply and take-up rolls 122 and 124 loaded with transfer film 116.

Figure 5:
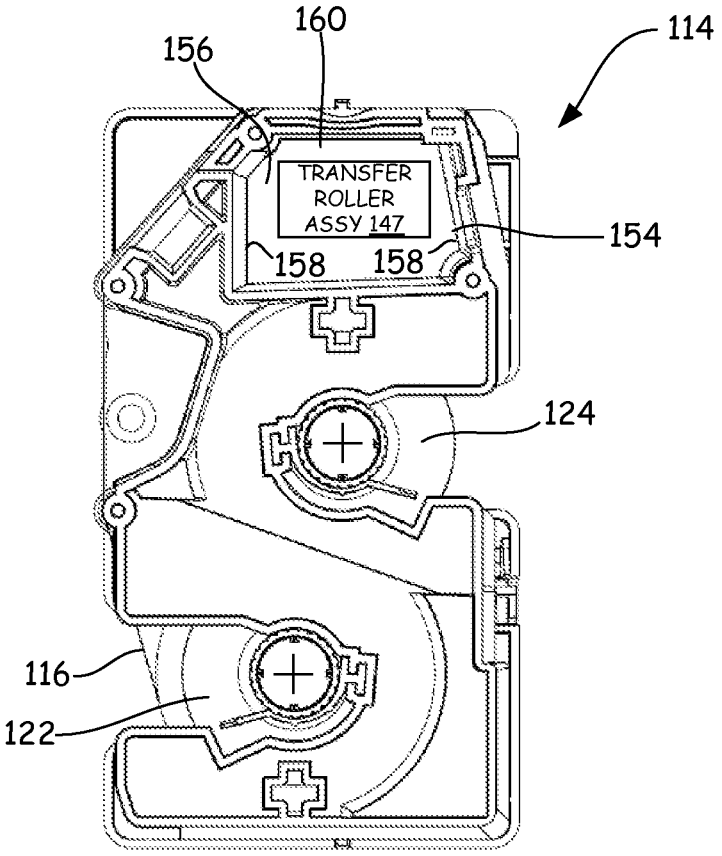
FIG. 5 illustrates a rear plan view of a transfer roller assembly under embodiments of the invention.

In FIG. 5, when transfer ribbon cartridge 114 is inserted credential production device 100, transfer roller assembly housing 152 is positioned within a housing 154 in transfer ribbon cartridge 114. Housing 154 includes a first end 156 that is part of a front support wall of transfer ribbon cartridge 114 and a second end opposite the first end that is open. Housing 154 also includes opposing sidewalls 158, an open top end where a width of transfer ribbon 116 extends between the front support wall of transfer ribbon cartridge 114 and a rear support wall 160 of transfer ribbon cartridge 114 and an open bottom end.

Figure 6:
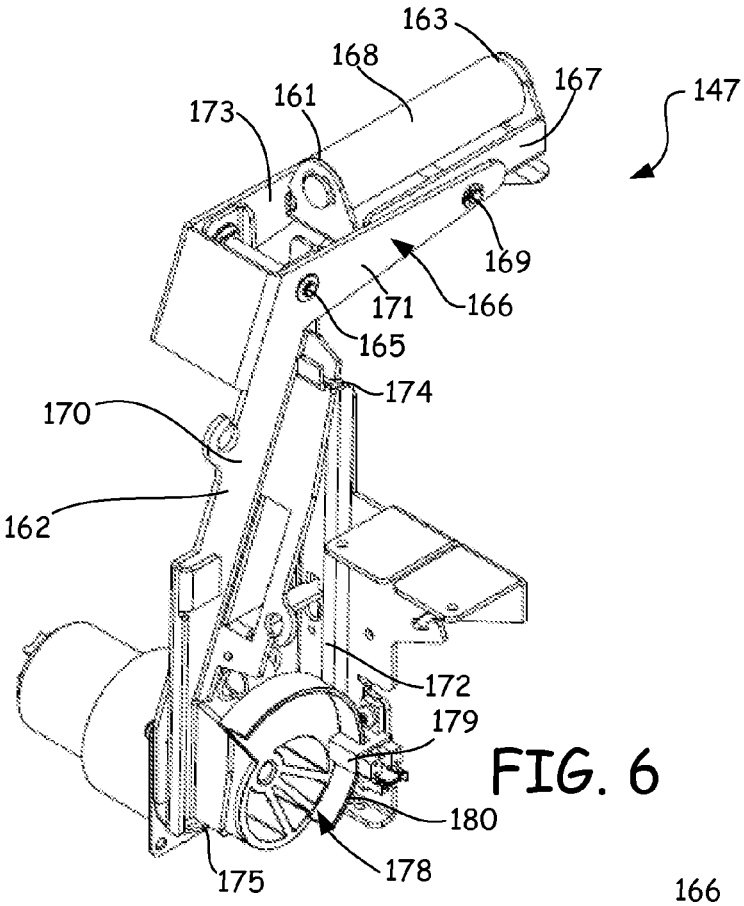
FIG. 6 illustrates a rear perspective view of a transfer roller assembly under embodiments of the invention.

FIG. 6 illustrates a rear perspective view of transfer roller assembly 147. In FIG. 6, housing 101 (FIG. 1) of credential production device 100 and internal frame 130 are removed for purposes of clearly illustrating transfer roller assembly 147. The transfer roller assembly 147 is also schematically illustrated in FIG. 7 in a simplified representation. Again, it should be understood that embodiments are not limited to a transfer roller assembly 147. Embodiments can include other assemblies that support other types of credential processing device components such as a printhead, a platen, and other types of rollers. Transfer roller assembly 147 is an exemplary embodiment.

Figure 7:
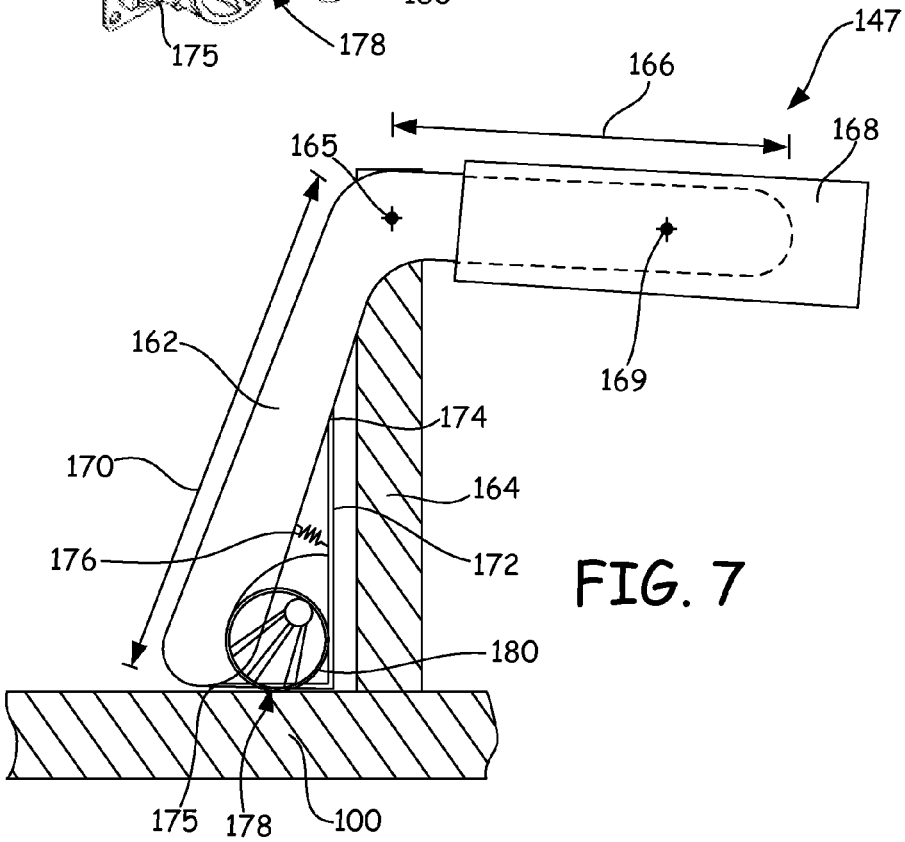
FIG. 7 illustrates a schematic representation of the transfer roller assembly of FIG. 6.

With reference to both FIG. 6 and FIG. 7, assembly 147 includes a support member 162 coupled to a frame 164. Frame 164 is a frame of a credential production device and/or a portion of a frame of a credential production device 100. Support member 162 is pivotally coupled to frame 164 at a pivotal axis 165. Support member 162 includes a first portion 166. As illustrated in both FIGS. 6 and 7, first portion 166 is cantilevered from frame 164 at pivotal axis 165. First portion 166 includes first and second side plate members 171 and 173 that are spaced apart from each other and are oriented in parallel. A credential processing device component 168 is coupled to first portion 166 of support member 162 at a pivotal axis 169. While pivotal axis 165 allows support member 162 to relatively rotate about frame 164, pivotal axis 169 allows credential processing device component 168 to relatively rotate about first portion 166 of support member 162. In general, pivotal axis 169 is located in the center of credential processing device component 168. However, pivotal axis 169 can couple credential processing device component 168 to first portion 166 in a location other than the center of credential processing device component 168. In the embodiment illustrated in FIGS. 6 and 7, credential processing device component 168 is a transfer roller. However, in other embodiments, credential processing device component can be other types of components used in processing a credential substrate, such as a printhead, platen and other types of rollers. For example and as illustrated in FIG. 6, transfer roller 168 comprises first and second ends 161 and 163. The first and second ends 161 and 163 of transfer roller 168 are secured within a transfer roller bracket 167. Transfer roller bracket 167 is positioned between and pivotally coupled to first side plate member 171 and second side plate member 173 of first portion 166 at pivotal axis 169.

Support member 162 also includes a second portion 170 that is integrally connected to first side plate member 171 of first portion 166. Second portion 170 extends at an angle to first portion 166 and has a fixed position relative first portion 166. Second portion 170 of support member 162 includes a spring arm 172 that is coupled to second portion 170 at three points. A first end 174 and a second end 175 are attached to second portion 170. In addition, spring arm 172 is attached to second portion 170 by a spring 176 (FIG. 7). Assembly 147 also includes an actuation mechanism 178 coupled to frame 164. Actuation mechanism 178 is configured to engage second portion 170 of support member 162 to pivot the second portion 170 and therefore first portion 166 about pivotal axis 165. Actuation mechanism 178 acts as a biasing mechanism for biasing first portion 166 into an operating position. Assembly 147 also includes a sensor 179 (FIG. 6). Sensor 179 is configured to sense an angular position of first portion 166 relative to frame 164. Actuation mechanism 178 receives signals from sensor 179 to determine how far first portion 166 should be biased into an operation position.

As illustrated in FIGS. 6 and 7, actuation mechanism 178 is a cam mechanism 180 operably coupled to a motor (not illustrated in FIG. 6 or 7). Cam mechanism 180 is configured to apply pressure on spring arm 172 to rotate second portion 170 and therefore first portion 166 about pivotal axis 165. By rotating second portion 170 and therefore first portion 166 about pivotal axis 165, actuation mechanism 178 moves credential processing device component 168 into a path of a credential substrate for processing.

In one example, a credential production device, such as credential production device 100 (FIGS. 1, 2 and 3), includes a ribbon, such as print ribbon 112 or transfer ribbon 116 (FIG. 3). Actuation mechanism 178 is configured to rotate second portion 170 and therefore first portion 166 and credential processing device component 168 into an operating position in which pressure is applied to the ribbon. In such an operating position, pivotal axis 169 allows credential processing device component 168 to rotate about first portion 166. Such a movement is available for making fine-tune position adjustments. For example, such a movement adjusts credential processing device component 168 to further accommodate different sizes of credential substrates. Actuation mechanism 178 is also configured to reversely rotate second portion 170 and therefore first portion 166 and credential processing device component 168 into a non-operating position in which no pressure is applied to the ribbon.

In another example, credential processing device component 168 is a transfer roller that is coupled to first portion 166 of support member 162 at pivotal axis 169. Actuation mechanism 178 is configured to rotate second portion 170 and therefore first portion 166 and the transfer roller into an operating position in which the transfer roller is moved into a transfer ribbon path. Actuation mechanism 178 further rotates second portion 170 and therefore first portion 166 and the transfer roller such that the transfer roller is applying pressure on the transfer ribbon and a credential substrate such that ink on the transfer ribbon is transferred to the credential substrate using heat from the transfer roller and pressure supplied by the actuation mechanism 178. In this example, actuation mechanism 178 is also configured to reversely rotate second portion 170 and therefore first portion 166 and the transfer roller into a non-operating position in which the transfer roller is moved away from the transfer ribbon path.

Although the present invention has been described with reference to preferred embodiments, workers skilled in the art will recognize that changes may be made in form and detail without departing from the spirit and scope of the invention.

What is claimed is:

1. A credential production device comprising:

a frame having a cartridge chamber;

a substrate input;

a substrate transport configured to deliver individual substrates from the substrate input along a processing path;

a support member having a first end and a second end, the support member pivotally coupled to the frame at a first axis located between the first end and the second end such that the support member is divided into a first portion extending from the first axis to the first end and a second portion extending from the first axis to the second end; and a transfer roller coupled to the first portion of the support member and configured to rotate about a transfer roller axis, which is perpendicular to the first axis;

wherein the transfer roller is supported within the cartridge chamber during installation of a transfer ribbon cartridge into the cartridge chamber and removal of a transfer ribbon cartridge from the cartridge chamber.

2. The device of claim 1, wherein the first portion pivots about the first axis.

3. The device of claim 2, further comprising a spring arm coupled to the second portion of the support member by at least a spring.

4. The device of claim 3, further comprising a cam mechanism configured to pivot the support member about the first axis and therefore move the first portion into an operating position.

5. The device of claim 2, further comprising a sensor configured to sense an angular position of the first portion relative to the frame.

6. The device of claim 2, wherein:

the second portion of the support member extends at an angle to the first portion and has a fixed position relative to the first portion; and an actuation mechanism configured to engage the second portion and pivot the first and second portions about the first axis.

7. The device of claim 6, further comprising a sensor configured to sense an angular position of the first portion relative to the frame.

8. The device of claim 1, wherein the transfer roller is coupled to the first portion of the support member by a pivotal coupling such that the credential processing device component pivots about a second axis relative to the first portion of the support member, the second axis being perpendicular to the transfer roller axis and parallel with the first axis.

9. The device of claim 1, wherein:

the transfer roller is configured to pivot about the first axis between an operating position in which the component applies a pressure to a ribbon supported by a transfer ribbon cartridge installed in the cartridge chamber and a non-operating position in which the component does not apply a pressure to the ribbon.

10. A credential production device comprising:

a frame;

a transfer ribbon cartridge removably received within a cartridge chamber of the frame;

a support member having a first end and a second end, the support member pivotally coupled to the frame at a first axis located between the first end and the second end such that the support member is divided into a first portion extending from the first axis and a second portion extending from the first axis to the second end;

a transfer roller supported by the first portion of the support member within the cartridge chamber and the transfer ribbon cartridge and configured to rotate about a transfer roller axis, which is perpendicular to the first axis; and an actuation mechanism configured to rotate the support member about the first axis to position the transfer roller into an operating position for applying a transfer ribbon supported in the transfer ribbon cartridge to a credential substrate while the first portion is cantilevered from the frame;

wherein the transfer roller is supported within the cartridge chamber during installation of the transfer ribbon cartridge into the cartridge chamber and removal of the transfer ribbon cartridge from the cartridge chamber.

11. The device of claim 10, wherein the transfer roller is pivotally coupled to the first portion of the support member at a second axis, the second axis being perpendicular to the transfer roller axis and in parallel with the first axis.

12. The device of claim 11, wherein the second portion extends at an angle to the first portion and has a fixed position relative to the first portion.

13. The device of claim 12, further comprising a spring arm coupled to the second portion of the support member by at least a spring.

14. The device of claim 13, wherein the actuation mechanism is configured to apply pressure on the spring arm to pivot the second portion and the first portion of the support member about the first axis.

15. The device of claim 10, wherein the actuation mechanism comprises a cam mechanism.

16. The device of claim 10, further comprising a sensor configured to sense an angular position of the first portion relative to the frame.

17. A credential processing assembly for a credential production device comprising:

a support member pivotally coupled to a fixed frame at a first axis and including a first portion pivotally cantilevered from the first axis, wherein the first axis allows the support member to rotate relative to the fixed frame;

a transfer roller configured to rotate about a transfer roller axis and being pivotally coupled to the first portion of the support member at a second axis, wherein the transfer roller axis is perpendicular to the first axis and the second axis; and an actuation mechanism configured to move the support member about the first axis to move the transfer roller into an operating position for processing a credential substrate while the first portion remains cantilevered from the frame.

18. The credential processing assembly of claim 17, wherein the transfer roller comprises first and second ends that are secured within a transfer roller bracket, the transfer roller bracket being pivotally coupled to the first portion of the support member at the second axis.

19. The credential processing assembly of claim 18, wherein the first portion of the support member comprises first and second side plate members that are spaced apart from each other and are oriented in parallel, the transfer roller bracket positioned between and pivotally coupled to the first side plate member and the second side plate member.

20. The credential processing assembly of claim 19, wherein the support member includes a second portion integrally connected to the first side plate member of the first portion.

* * * * *